US007913524B2

(12) United States Patent
Aurich et al.

(10) Patent No.: US 7,913,524 B2
(45) Date of Patent: Mar. 29, 2011

(54) APPARATUS FOR DYEING TEXTILE SUBSTRATES WITH FOAMED DYE

(75) Inventors: Christoph Walter Aurich, Clemson, SC (US); Dieter Friedrich Zeiffer, Iron Station, NC (US); Hermann A. Neupert, Belmont, NC (US)

(73) Assignee: Gaston Systems, Inc., Stanley, NC (US)

( * ) Notice: Subject to any disclaimer, the term of this patent is extended or adjusted under 35 U.S.C. 154(b) by 534 days.

(21) Appl. No.: 12/012,077

(22) Filed: Jan. 31, 2008

(65) Prior Publication Data

US 2008/0184747 A1 Aug. 7, 2008

Related U.S. Application Data

(63) Continuation-in-part of application No. 11/805,893, filed on May 25, 2007, which is a continuation-in-part of application No. 10/833,450, filed on Apr. 28, 2004, now abandoned.

(51) Int. Cl.
*D06B 3/10* (2006.01)

(52) U.S. Cl. ..... 68/205 R; 68/200

(58) Field of Classification Search ..... 68/205 R, 68/200

See application file for complete search history.

(56) References Cited

U.S. PATENT DOCUMENTS

| | | | | | |
|---|---|---|---|---|---|
| 3,067,758 | A | * | 12/1962 | Hersh | 134/114 |
| 3,969,780 | A | * | 7/1976 | Henderson | 8/149.1 |
| 4,023,526 | A | | 5/1977 | Ashmus et al. | 118/410 |
| 4,061,001 | A | | 12/1977 | Von der Eltz et al. | 68/200 |
| 4,099,913 | A | | 7/1978 | Walter et al. | 8/173 |
| 4,193,762 | A | | 3/1980 | Namboodri | 8/14 |
| 4,237,818 | A | | 12/1980 | Clifford et al. | 118/410 |
| 4,283,198 | A | * | 8/1981 | Fletcher | 8/653 |
| 4,305,169 | A | * | 12/1981 | Vidalis | 8/149 |
| 4,365,968 | A | | 12/1982 | Gregorian et al. | 8/477 |
| 4,402,200 | A | | 9/1983 | Clifford et al. | 68/200 |
| 4,435,965 | A | * | 3/1984 | Sasseville et al. | 68/205 R |
| 4,532,782 | A | * | 8/1985 | Sellers | 68/13 R |
| 4,562,097 | A | | 12/1985 | Walter et al. | 427/209 |
| 4,613,335 | A | | 9/1986 | Berendt et al. | 8/477 |
| 4,655,056 | A | | 4/1987 | Zeiffer | 68/205 R |
| 4,884,893 | A | | 12/1989 | Zeiffer et al. | 366/176 |
| 5,063,646 | A | | 11/1991 | Zeiffer et al. | 28/167 |
| 5,168,731 | A | * | 12/1992 | Vidalis | 68/200 |
| 5,195,225 | A | | 3/1993 | Zeiffer et al. | 28/167 |

(Continued)

FOREIGN PATENT DOCUMENTS

DE 30 34 802 A1 3/1982

(Continued)

OTHER PUBLICATIONS

European Patent Application EP 1 591 578 A3.

(Continued)

*Primary Examiner* — Frankie L Stinson
(74) *Attorney, Agent, or Firm* — K&L Gates LLP

(57) ABSTRACT

An apparatus for dyeing a textile substrate using a plurality of applicators that each apply an increment of a total dye application. In one form a reduced indigo dye in a leuco-state is applied in an inert atmosphere substantially isolated from oxidizing substances. In another form the foamed dye is applied while open to the atmosphere. In both forms hold-down rollers or inverted applicators are located between applicators at decreasing depths to minimize increases in tension as the substrate travels over successive applicator faces.

4 Claims, 15 Drawing Sheets

U.S. PATENT DOCUMENTS

| | | | | |
|---|---|---|---|---|
| 5,201,959 | A * | 4/1993 | Fuller | 68/9 |
| 5,219,620 | A * | 6/1993 | Potter et al. | 427/434.2 |
| 5,323,629 | A | 6/1994 | Aurich et al. | 68/27 |
| 5,494,491 | A * | 2/1996 | Gurley | 8/625 |
| 6,355,073 | B1 | 3/2002 | Godau | |
| 6,395,088 | B1 | 5/2002 | Zeiffer | 118/410 |
| 6,432,202 | B1 * | 8/2002 | Aurich | 118/420 |
| 6,852,196 | B2 * | 2/2005 | Capizzi | 162/101 |
| 6,858,256 | B2 * | 2/2005 | Zeiffer | 427/345 |
| 2005/0241078 | A1 | 11/2005 | Aurich et al. | 8/518 |
| 2007/0266505 | A1 | 11/2007 | Aurich et al. | 8/477 |

FOREIGN PATENT DOCUMENTS

| | | | |
|---|---|---|---|
| DE | 30 34 803 | A1 | 3/1982 |
| EP | 0525434 | A1 | 2/1993 |
| EP | 0799924 | A2 | 10/1997 |
| EP | 0995826 | A2 | 4/2000 |
| EP | 1 065 3082 | A2 | 1/2001 |
| EP | 1657338 | A2 | 5/2006 |
| WO | WO 2006/013458 | A1 | 2/2006 |

OTHER PUBLICATIONS

PCT International Search Report.

* cited by examiner

APPARATUS FOR DYEING TEXTILE SUBSTRATES WITH FOAMED DYE

This application is a continuation-in-part of pending U.S. patent application Ser. No. 11/805,893, filed May 25, 2007, published Nov. 22, 2007, as Publication No. 2007-0266505-A1, which is a continuation-in-part of U.S. patent application Ser. No. 10/833,450, filed Apr. 28, 2004, published Nov. 3, 2005, as Publication No. 2005-0241078-A1, now abandoned.

BACKGROUND OF THE INVENTION

The present invention relates to an apparatus for dyeing textile substrates with a foamed dye. In one form, the present invention relates to an apparatus for dyeing textile substrates containing cellulosic fibers with a reduced leuco-state dye foamed with an inert gas and applied in the leuco foamed state in an inert atmosphere to the textile substrate and subsequently oxidized thereon to affix the indigo dye to the cellulosic fibers of the textile substrate. In another form, the present invention relates to dyeing a textile fabric substrate with foamed dye applied incrementally by a plurality of spaced applicators.

Dyeing cellulosic textile material, such as cotton yarn or fabric, with a leuco-state dye, such as indigo dye, has a large market, particularly for cotton denim clothing items, such as blue jeans. The fastness of the indigo dye on cotton and the deep color or shade that can be obtained make indigo dyed fabric a very popular product. However, dyeing cellulosic textile material with indigo dye is a complicated, complex and expensive procedure, because indigo in its natural state will not affix to cellulosic fibers. To render the indigo dye capable of affixing to cellulosic fibers, it is necessary to reduce the indigo by removing oxygen as by mixing with hydro (hydrosulfite) or other reducing agents to render the indigo a colorless leuco-state material. It then must be handled to remain in a substantially leuco-state until it is applied to the cellulosic textile material. To be capable of being applied, the leuco-state indigo dye must be sufficiently dilute to penetrate into the interstices of the cellulosic material. Typically, indigo dye is obtained from a supplier in a paste form that is, for example, in a 40% solution. It then must be further diluted to, for example, a 2% solution with a non-oxidizing liquid, such as hydro and caustic soda, to maintain the leuco-state to be capable of penetration into a traveling textile substrate that is immersed through a vat of the diluted indigo dye. Because of this dilution, it is necessary to pass the textile substrate through a series of sequential indigo dye vats with intermediate exposure to the atmosphere or other oxidizing agents to set the indigo applied during the preceding immersion. To obtain a desired deep color or shade, it is common to utilize a dyeing range having anywhere from four to eight, dye vats in series with arrangements of guide rolls between vats to assure proper oxidation of the indigo between vats. In addition, the dye in the vats must be continuously and rapidly recirculated in a tank or tanks into which reduced water or other similar material is added and regulated to remove oxygen taken up in the dye vats and to return any oxidized indigo dye to the reduced leuco-state.

A significant problem with prior art indigo dyeing ranges is that of waste dye and water disposal. Because of the numerous vats and the amount of dye liquor that must be provided, there is a significant quantity of dye liquor that must be disposed of at the end of every dyeing operation. This creates an undesirable substantial expense and environmental problem.

Another prior art dyeing system is disclosed in U.S. Pat. No. 4,613,335, issued Sep. 23, 1986, to Hans-Ulrich Berendt, et al. This patent discloses a process for dyeing or printing cellulosic-containing textile material with a reduced leuco-state dye in a foam carrier. While mentioning dyeing, the disclosure is primarily directed to printing, and there is no disclosure of the substrate being in a sealed, inert atmosphere. Rather, the substrate is exposed to the atmosphere as it approaches the applicator, as it passes across the applicator, and as it leaves the applicator. Therefore, there is no control of the condition of the substrate as it approaches and passes under the applicator and no control of the oxidation of the dye after it is applied to the substrate.

In contrast, the present invention, in one form, provides for the applicator face and substrate to be in a controlled inert atmosphere so that the foam can be applied without oxidation or controlled oxidation of the leuco-state dye and the foam can at least partially collapse in the inert atmosphere allowing the dye in its leuco-state to disperse on the substrate without oxidation or with controlled limited oxidation before it is fully oxidized as the substrate leaves the inert atmosphere, assuring that desirable affixing of the dye on the substrate occurs when the substrate is exposed to the atmosphere.

In another form of the present invention, the apparatus is not limited to dyeing of any particular textile fabric substrate, which dye can be in the leuco-state or any other form that is foamed for application to the traveling substrate. Also, it is not limited to a dyeing chamber sealed from ambient air, but can be utilized with a sealed chamber or a chamber that is open to ambient air. This form of the apparatus utilizes a plurality of spaced foam applicators applying dye in foam form onto the surface of the substrate in increments and being spaced apart to permit at least partial collapse of the foam between applicators.

SUMMARY OF THE INVENTION

Briefly described, in one form the present invention provides an apparatus for dyeing textile substrates containing cellulosic fibers with a foamed reduced leuco-state dye. The apparatus includes a housing having an interior chamber sealed from atmospheric air and through which the substrate travels from an entrance having a seal through which the substrate enters the chamber to an exit having a seal through which the substrate exits the chamber. A supply of inert gas communicates with the chamber to provide an inert environment therein. At least one foam applicator has an applicator face in said chamber and extending across the width of the substrate for applying foam containing the dye in leuco-state to the substrate in the chamber. A foam generator generates foam containing the leuco-state dye in the absence of oxygen with the generator communicating with the applicator for supplying the foamed leuco-state dye to the applicator. Thus, oxidation occurs primarily only after the substrate exits the chamber. However, there may be a minimal amount of oxygen in the otherwise inert gas and some small controlled amount of oxygen may purposely be included in the inert gas for desired controlled partial oxidization of the dye before it exits the chamber. Preferably, the supply of inert gas is under pressure to provide a pressurized inert environment in the chamber and minimize the entry of any atmospheric air through the entrance and exit. Also, preferably, the at least one applicator is spaced from the entrance to provide a free reach of the substrate in which air trapped in the interstices of the substrate is allowed to escape, and the at least one applicator is spaced from the exit to allow foam on the substrate to collapse and deposit and distribute the leuco-state dye on the substrate before the substrate exits the chamber and the dye is oxidized.

In a preferred embodiment of this form of the present invention there is a plurality of applicators with application faces in the chamber and disposed with spaces therebetween to allow foam to at least partially collapse and the leuco-state dye to at least partially deposit on the substrate before having foam applied by the following applicator. Holddown elements, which may be in the form of rollers, may be disposed between the applicators for engaging the substrate to displace the substrate between the applicators to maintain the substrate in foam receiving engagement with the applicator faces. The applicators are preferably parabolically shaped for uniform distribution of foam across the width of the substrate.

In this preferred embodiment, the inert gas is nitrogen and the foam generator generates a foam of nitrogen containing the leuco-state dye. One advantage of nitrogen being in the foam is that when the foam collapses in the chamber, the nitrogen increases the amount of inert nitrogen in the chamber environment.

This form of the present invention has special application to dyeing woven denim fabric with indigo dye, which may be applied at a weight of approximately 5% to 20% of the weight of the fabric and preferably 10% to 15%.

To allow access into the chamber, the housing may have an openable cover sealingly mounted thereon and the holddown elements may be mounted on a frame that is moveable to move the holddown elements away from the spaces between applicators when the cover is open.

In another form of the present invention, the apparatus is directed to dyeing a traveling textile fabric substrate in a housing having an interior chamber through which the substrate travels. An entry roller assembly feeds the substrate into the chamber and an exit roller assembly draws the substrate from the chamber. A plurality of spaced foam applicators are disposed in the chamber and have applicator faces extending transversely of the traveling substrate for applying dye in foam form onto the surface of the substrate in increments, with the space between applicators permitting at least partial collapse of foam between applicators to facilitate dye application by the subsequent applicator. To maintain the traveling substrate in contact with the foam delivery faces of the applicators, holddown elements, which may be in the form of rollers, extend between applicators below the level of the applicator faces. The holddown elements are preferably idler rollers and to minimize an increase in the tension in the traveling substrate as it progresses over successive applicators, the depth of the holddown elements between the applicators gradually decreases in the direction of travel of the substrate to reduce the angle of inclination and thereby reduce tension causing friction. This decrease in depth can be obtained by providing the housing with a cover to which the holddown elements are attached with spacer blocks therebetween with the number of spacer blocks decreasing with successive holddown elements in the direction of travel of the substrate. The chamber may be sealed from atmospheric air in the manner of the previously described form of the present invention, or the chamber may be open to the atmosphere when dyeing with non-leuco-state dye. The entry roller assembly and the exit roller assembly are driven synchronously to maintain substantially uniform tension in the substrate as it travels through the apparatus to facilitate uniform incremental application of foam. A first holddown element or roller is mounted in advance of the first of the applicators and a last holddown element or roller is mounted after the last of the applicators, with the first and last holddown elements guiding the substrate at the same level as the entry and exit roller assemblies.

In both of the forms of the present invention described above the holddown elements between the applicators are preferably either idler rollers or inverted applicators with their faces engaging and holding down the top surface of the applicators. In using inverted applicators, dye foam is applied to the top surface of the substrate, which could be the same color as, a different color than, the same dye as, or a different dye than the dye applied by the lower applicators. Additionally, whether using only the lower applicators or both lower and upper applicators, the different applicators can be used to apply different colors and/or different dyes in the same apparatus, whether it be with an inert atmosphere or ambient air.

DETAILED DESCRIPTION OF THE PREFERRED EMBODIMENTS

Figure 1:
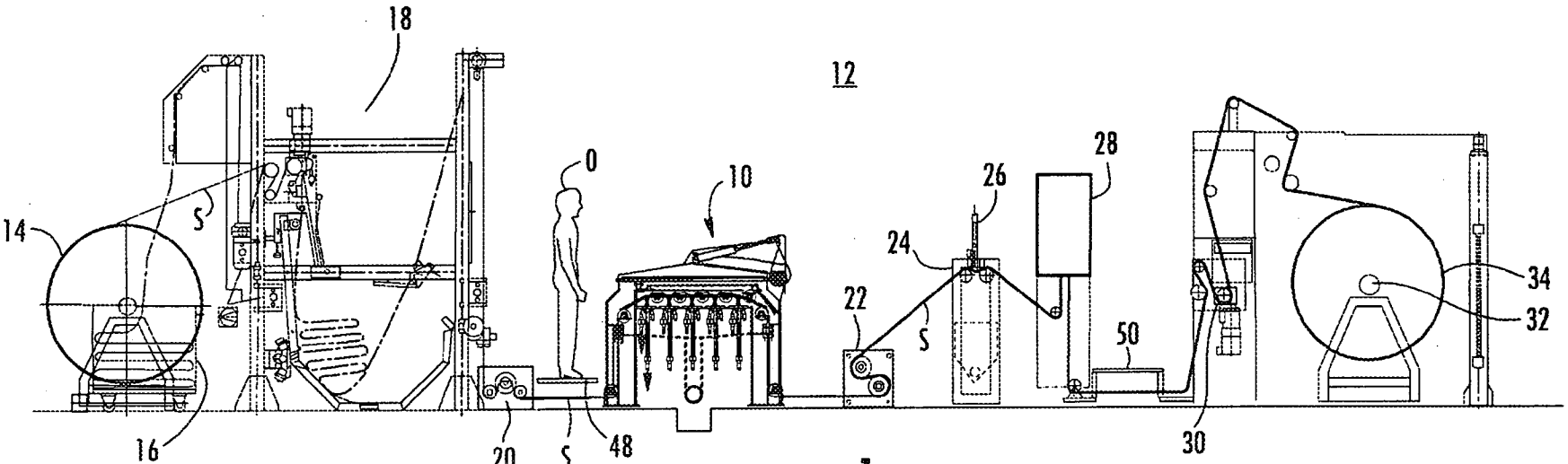
FIG. 1 is a side elevation of a dyeing range in which the apparatus of one form of the preferred embodiment of the present invention is incorporated.
Figure 2:
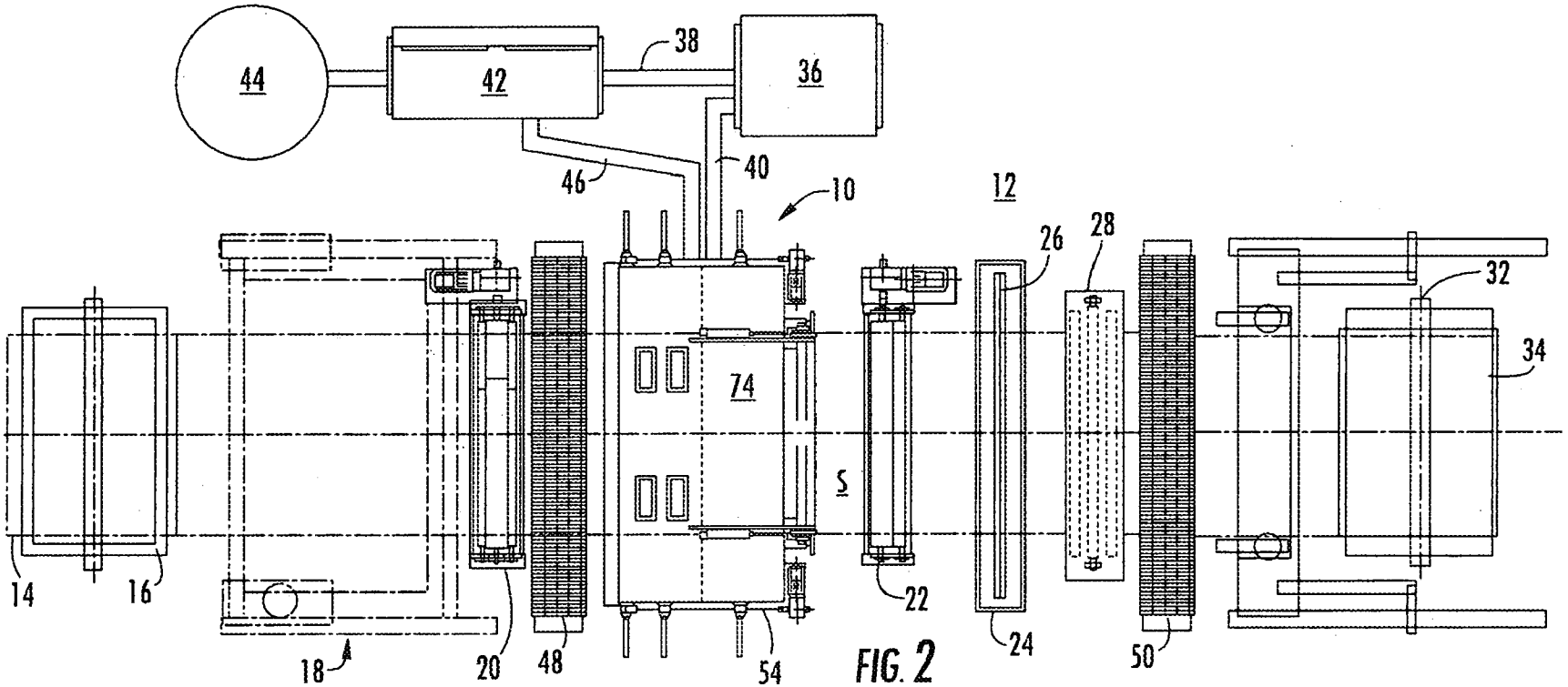
FIG. 2 is a plane view of the dyeing range of FIG. 1.

The dyeing apparatus 10 of one form of the preferred embodiment of the present invention is illustrated in FIGS. 1-8, of which FIGS. 1 and 2 illustrate the apparatus incorporated in a dyeing range 12. A sheet of textile substrate S is fed to the range 12 from a supply roll 14 or a supply of plaited material in a supply box 16. The substrate S is then relaxed in a J-box 18 from which it is withdrawn by a feed roll assembly 20 from which the substrate travels under a crosswalk grid 48 on which an observer O stands to monitor the dyeing operation in the dyeing apparatus 10. The substrate is drawn through the dyeing apparatus 10 by a driven pull roll assembly 22. The drive of the feed roll assembly 20 and pull roll assembly 22 are controlled so that a desired tension is being maintained in the substrate S as it travels through the apparatus 10. From the pull roll assembly 22 the substrate may be subjected to a supplemental treatment at a supplemental dye application station 24, at which a foam applicator 26 applies a surface treatment, such as the same or different dye as applied in the dyeing apparatus 10, or any other desired surface treatment material, which surface treatment can be applied to either surface of the substrate. The treated substrate then passes through an infrared dryer 28 to reduce the moisture content to a desired level. Any other type of dryer could be substituted. From the dryer 28, the substrate S passes under a crosswalk grid 50 over a series of guide rolls 30, and is wound on a driven takeup roll 32 to form a roll 34 of the dyed substrate S.

As illustrated schematically in FIG. 2, an inert gas is fed to the dyeing apparatus 10 from a source 36, which can be a supply tank containing the inert gas or a generator of the inert gas, such as a nitrogen generator. The gas is fed through a supply line 40 to the interior of the apparatus 10 to provide an inert environment.

The inert gas is also fed, from the source through a second supply line 38 to a foam generator 42, which also receives a reduced, leuco-state dye from a dye supply tank 44. The dye supply tank 44 is maintained under seal that prevents air from entering the supply tank 44 as dye is fed therefrom to the foam generator 42 so as to prevent oxidation of the leuco-state dye. The foam generator is of any conventional type that can create a foam using the nitrogen and having the dye dispersed therein, which foam is then fed through a feed line 46 into the dyeing apparatus 10.

The dyeing apparatus 10 is illustrated in detail in FIGS. 3-8. A front guide roll 52, under which the substrate travels, directs the substrate S from a horizontal direction to a vertical direction. The front guide roll 52 is mounted on the housing 54 of the dyeing apparatus 10.

Figure 3:
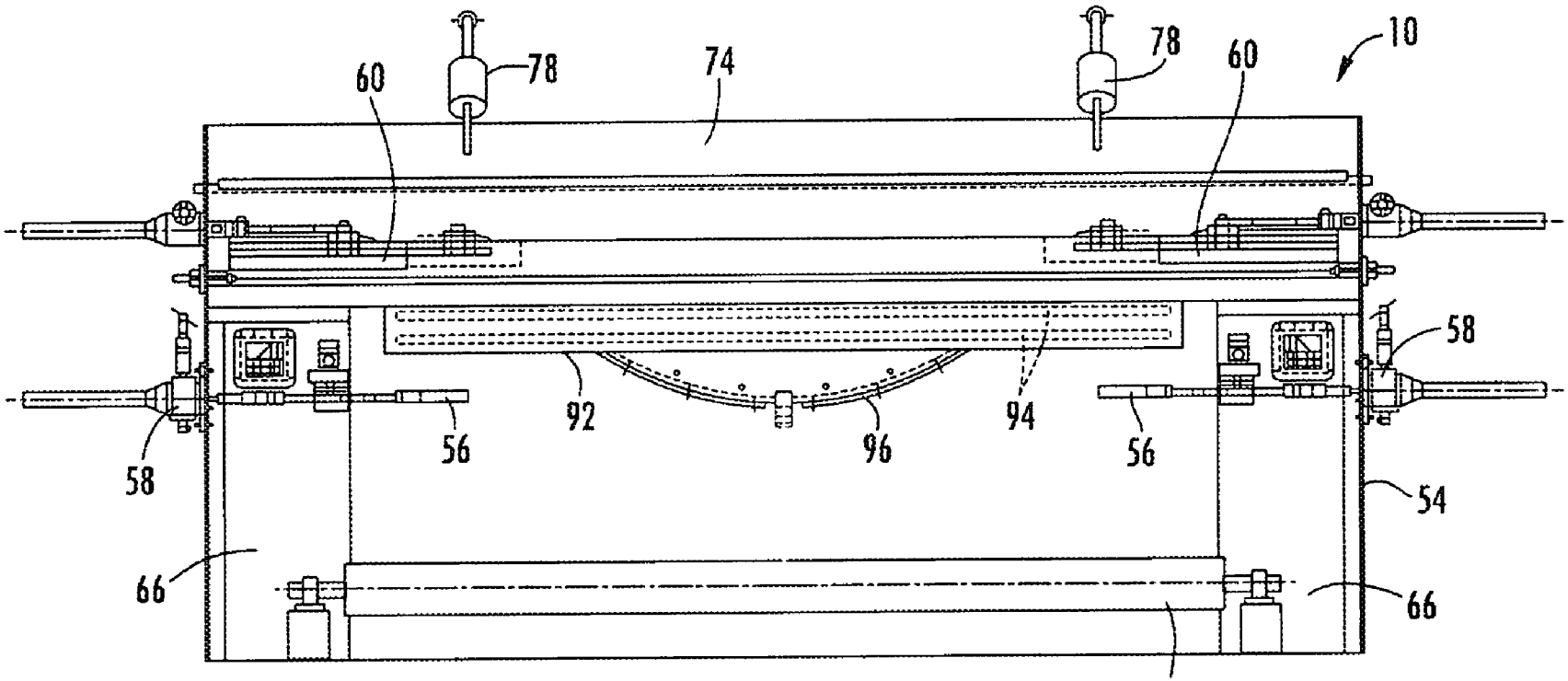
FIG. 3 is an end elevation of the entrance end of the dyeing apparatus included in the dyeing range of FIGS. 1 and 2.
Figure 4:
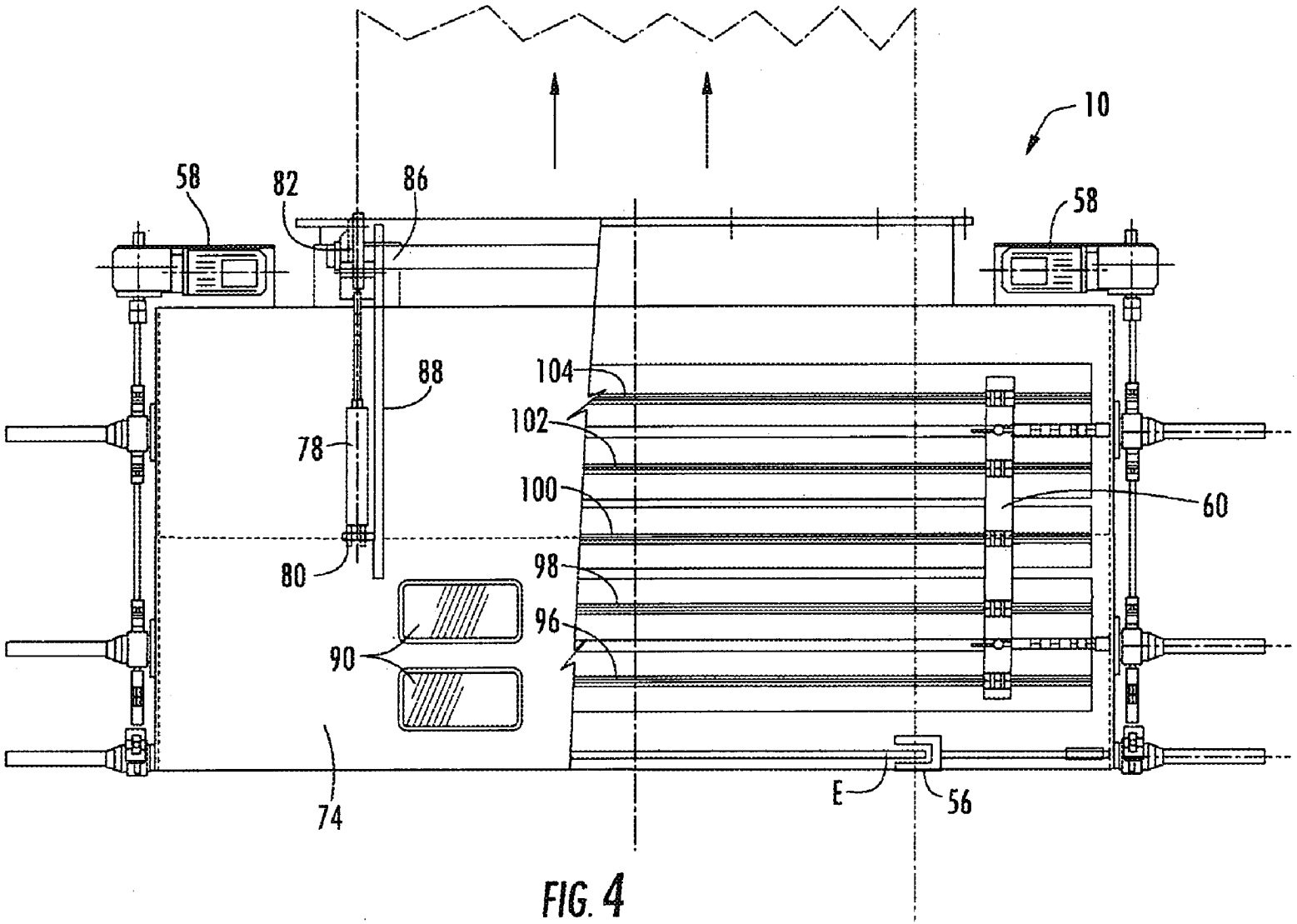
FIG. 4 is a plane view of the apparatus of FIG. 3 with a portion of the cover removed.
Figure 5:
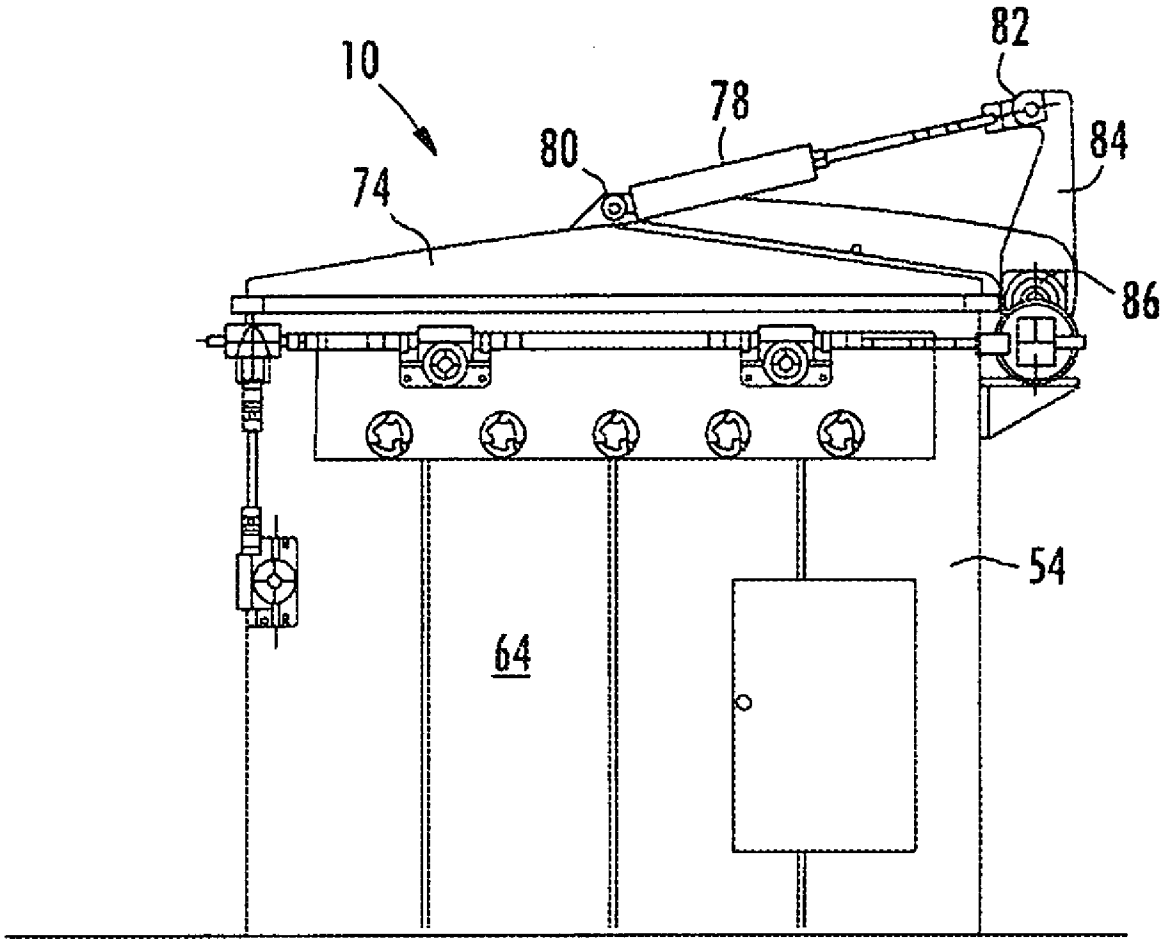
FIG. 5 is a side elevation of the apparatus of FIG. 3.

As the substrate S travels vertically from the front guide roll 52, its edges E pass through a pair of opposed sensing forks 56, illustrated in FIGS. 3 and 4, that sense the location of the edges E. In response to sensing of the position of the edges E of the substrate S, servo motors 58 adjust end seals 60 to limit foam application to the lateral extent of the substrate without significant escape of foam from the applicators beyond the position of the lateral edges E of the substrate S.

The housing 54 is formed with opposite side panels 64 and corner support legs 66. The upper portion of the housing 54 is formed as a chamber 68 formed by front and rear walls 70, 71, the side panels 64 of the housing, a bottom wall 72, L-shaped walls 73 extending from the bottom wall 72 to entrance and exit seals 92 and 126, and a pivotable cover 74 that sealingly seats on the upper edges of the walls 70 and panels 64 with sealing material, such as resiliently compressible foam material, disposed therebetween, or the seal could be provided by a trough containing water formed at the top of the walls 70 and panels 64 with the bottom edges 76 of the cover seated within the water in the trough (not illustrated). The cover 74 is opened and closed by a pair of laterally spaced piston cylinder mechanisms 78 that have ends 80 attached centrally to the cover 74 and other ends 78 attach to upstanding support posts 84 that extend upwardly from the top of the housing 54. To accommodate this pivoting of the cover 74, it is mounted on a pivot shaft 86, on which are also mounted support bars 88 adjacent the piston cylinder mechanisms 78 and centrally of the cover 74. These support bars 88 stabilize the cover 74 during pivoting.

The cover 74 is formed with observation windows 90 through which the observer O can monitor the operation of the dyeing apparatus 10 as the substrate S travels therethrough. At the front of the chamber 68 the entrance seal 92 is located through which the substrate S passes into the chamber 68. This entrance seal 92 is formed by two pairs of spaced inflatable bladders 93 that prevent the entry of air into the inert environment within the chamber 68. Above the entrance seal 92 an entrance guide roll 94 directs the substrate S to a plurality of longitudinally spaced foam applicators 96, 98, 100, 102 and 104. The guide roll 94 is located below the level of the face 106 of the first foam applicator 96 to ensure positive engagement of the substrate S with the applicator face 106.

The applicators 96, 98, 100, 102 and 104 are mounted on the bottom wall 72 by flanges 103 on the applicators secured on the bottom wall 72.

A holddown roller mounting frame 108 is mounted above the foam applicators 96. This frame 108 has mounted on its underside four holddown rollers 110, 112, 114 and 116. These holddown rollers 110, 112, 114 and 116 are disposed between the foam applicators and project downwardly below the level of the faces of the applicators to force the substrate S to be deflected downwardly between applicators to assure positive engagement of the substrate S with the applicator faces 106.

The frame 108 carrying the holddown rollers 110, 112, 114 and 116 is pivoted on a pivot shaft 178 spaced rearwardly and upwardly from the last foam applicator 104. The frame is retained in operating position by wingnuts 180 attachable to upstanding brackets 122 forwardly of the first foam applicator 96. A coil spring 121 secured to the rear wall 71 of the chamber 68 and a rearward extension 140 of the frame 108 biases the frame 108 to an open position so that when the wingnuts 120 are released, the frame 108 will pivot upwardly into an open position.

Beyond the last foam applicator 104, an exit guide roll 124 is mounted below the level of the foam applicators for guiding the substrate S away from the foam applicators and downwardly through the exit seal 126 having pairs of spaced inflated sealing bladders, with the exit seal 126 and bladders 128 being identical to the entrance seal 92 and bladders 93, to prevent entrance of atmospheric air into the chamber 68.

Spaced below the exit seal 126 is a guide roll 130 that guides the substrate vertically downward and then horizontally outward to the pull roll assembly 22.

The entrance seal 92 and the entrance guide roll 94 are spaced from the first foam applicator 96 to provide a free reach of the traveling substrate during which air that may have been entrapped in the interstices of the substrate S and thereby entered the chamber 68 will have an opportunity to escape from the substrate interstices, thereby substantially avoiding any undesirable oxidation of the reduced, leuco-state dye when it is applied to the substrate.

The foam applicators 96, 98, 100, 102 and 104 are spaced from each other so that, as the substrate travels from one to the next, it is deflected by the intermediate guide rolls 110, 112, 114 and 116 to provide a free time between applicators for the foam to collapse and the dye disperse before dye is applied by the next applicator. Similarly, the exit guide roll 124 and exit seal 126 are spaced from the last foam applicator 104 to allow collapse of the foam and dispersion of the dye before the substrate leaves the inert atmosphere within the chamber 68 and the dye exposed to oxygen in the atmosphere beyond the exit seal 126.

Each of the foam applicators 96, 98, 100, 102 and 104 are, in the preferred embodiment of FIGS. 1-8, parabolically shaped applicators of the type disclosed in U.S. Pat. No.

4,655,056, issued Apr. 7, 1987, to Dieter F. Zeiffer. This type of applicator is particularly useful in that the parabolic shape distributes foam equally and over equal distances from the input to the full extent of the applicator face. Other types of applicators can also be used with varying results.

The applicator in the supplemental dye applying station 24 may also be of the parabolic shape, particularly if it is applying a foam, but any other type of dye or other surface treatment may be applied as well in other types of applicators.

Figure 6:
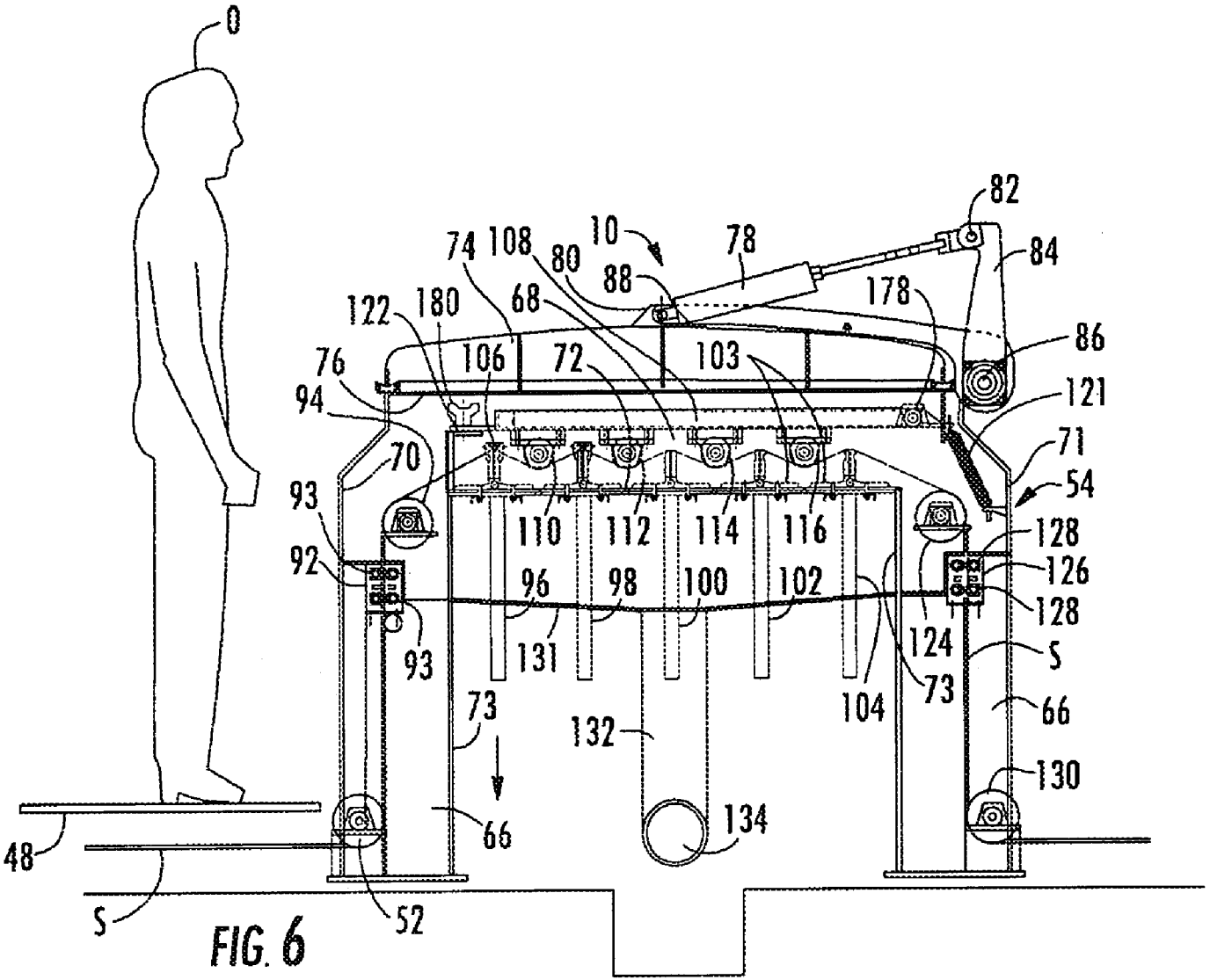
FIG. 6 is a side elevation of the apparatus of FIG. 3 with the side panel removed.
Figure 7:
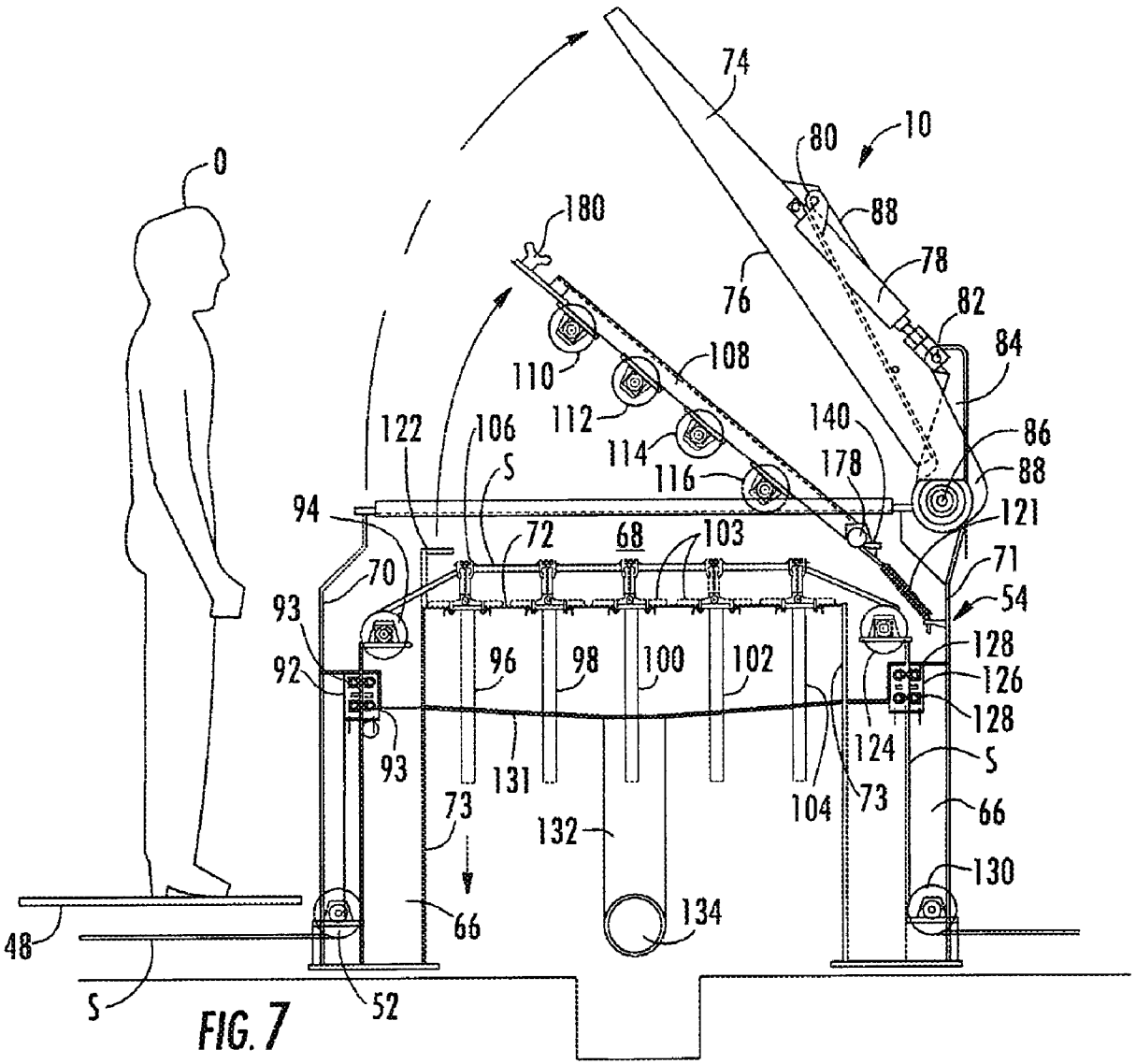
FIG. 7 is similar to FIG. 6 with the cover and roller frame open.

As seen in FIGS. 6 and 7, gutters 131 at each side of the chamber 68 outwardly of the applicators decline centrally toward drain pipes 132 that collect any excess dye or other liquid and have closures 134 that are openable at the end of a dye run to allow flushing of the chamber 68. The closures 134 also are open at the startup when nitrogen or other inert gas is fed from the inert gas source 36 under pressure into the chamber 68. As atmospheric air is heavier than nitrogen, the introduction of nitrogen under pressure will cause atmospheric air to exit the closure 134. When all or substantially all of the atmospheric air has exited the chamber 68, the closures 134 are sealed and the substrate S is threaded by a lead sheet or other means to begin operation. Alternatively, the substrate may be threaded before air is evacuated from the chamber 68, which will result in a short length of substrate being imperfectly dyed.

The purging of oxygen bearing air from the interstices of the fiber structure provided by the spacing of the entrance seal 92 and entrance guide roll 94 from the first applicator 96 prevents the dye liquor from oxidizing prematurely and rather allows subsurface liquor migration that would be restricted were the dye to oxidize, making it immobile resulting in a loss of control over distribution of the dye molecules.

However, as commercially supplied inert gas, such as nitrogen, contains some small amount of oxygen and as commercial inert gas generators do not produce totally pure inert gas, there may be a minimal amount of oxygen in the inert atmosphere, resulting in some unintentional slight oxidization of the dye on the substrate before the substrate leaves the chamber. An advantage of the present invention is that, if desired, some small controlled amount of oxygen may purposely be included, in any conventional manner, to provide partial oxidization of the dye on the substrate between and/or after dye application before the substrate leaves the chamber and the dye is substantially oxidized in the ambient atmosphere.

If acceptable, only one foam applicator can be incorporated in the apparatus with all of the foam being supplied through that one applicator, but preferably a plurality of foam applicators are used with each applicator applying a fraction, either equally distributed or selectively distributed, depending on preferences, and a much deeper shade can be obtained with the same amount of dye by applying multiple foam applications. With a plurality of foam applicators, with each applicator supplying a relatively small limited amount of dye-containing foam, the migration of the dye into the fiber surface can be a controlled process. Subsequent relatively small amounts of foam put onto the same fiber surface area, in a superimposed fashion, will allow for a dye enrichment to be achieved. Sequential dye applications are accomplished without any dye ever being allowed to oxidize until the final application is made. The substrate surface fibers are unable to satisfactorily absorb large foam volumes that are applied at one, rather than a plurality of, applicators as a large volume single application will disperse dye to a greater extent into the interior of the substrate rather than concentrating on the surface fibers. This allows dyeing with less moisture pickup and, therefore, less required drying and generation of less waste water.

With the spaces of the dye liquor delivery system filled with reduced dye, the liquor itself, which can be formulated at a low viscosity, incrementally applied to the fiber surface will provide a controlled specific infusion rate. The lowest viscosity of the foam can be maintained during the foam application, with the foam being in only a temporary delivery state. The foam collapses almost immediately upon fiber contact and does not hinder the dye infusion process. The superimposition of incrementally small amounts of liquor with time intervals, or infusion stages, between each subsequent foam application takes place with the dye being in a non-oxidized state, in striking contrast to the prior art.

In this form of the preferred embodiment, indigo dye in its reduced, leuco-state can be run at normal finishing range speeds, such as about sixty meters per minute. A typical fabric weight would be 400 grams per square meter, and a typical amount of indigo dye to be applied to one side of the fabric may be, for example, about 5% to about 30% of the weight of the fabric, which can be divided in any fashion between the five applicators. For example, each applicator could apply 2% of the dye liquor for a 10% total or 3% for a total of 15% total or unequal amounts or any combination can be distributed by the different applicators.

Figure 8:
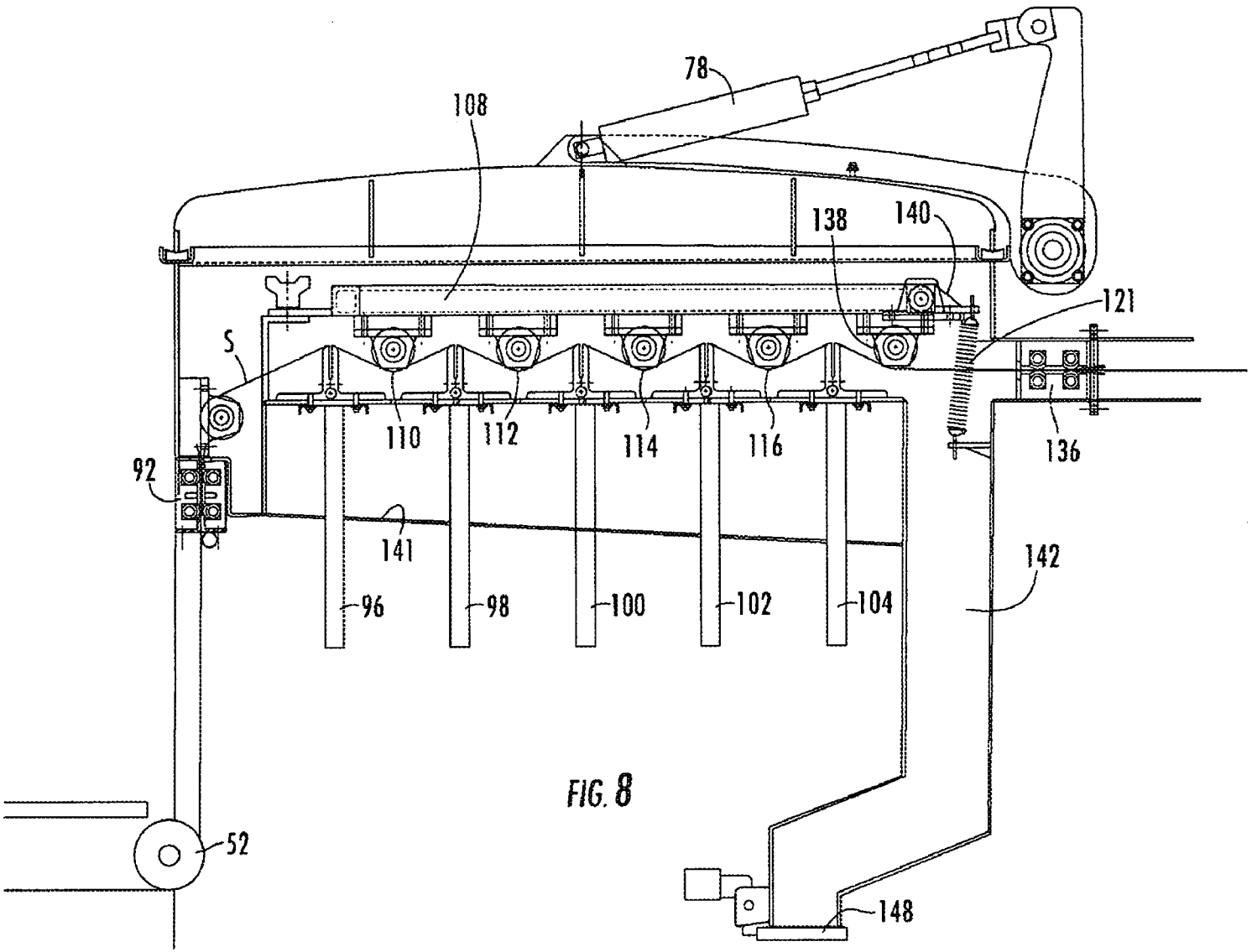
FIG. 8 is a view similar to FIG. 6 and illustrating alternative exit seals and drains.

FIG. 8 illustrates a modification of the location of the exit seal and drain pipe. In this arrangement, the exit seal 136 is located in a horizontal disposition for exit of the substrate horizontally and an exit guide roll 138 similarly located in the manner of the guide rolls 110, 112, 114 and 116 mounted similarly on the frame 108 as in the form of FIGS. 1-7, deflects the substrate downwardly following the last applicator 104, for guiding to the horizontal exit seal 136.

In this variation the drain pipes 142 are located at the rear of the housing 54, and the gutters 141 slant downwardly rearwardly to drain liquid from the chamber 146 into the gutters 141 and drain pipes 142 to exit from the drain pipes 142 when the drain pipe closures 148 are opened.

Variables, such as liquor flows, substrates speed, chemical formulations, purity of the nitrogen, degree of fabric preparation and fiber origin can have distinct effects upon the resulting shades. Also, while the substrate is primarily cellulosic for dyeing with indigo in the leuco-state, the substrate may contain some small amounts of synthetic fibers to obtain any desired results. Shade variations can easily be achieved by varying the number of applicators engaged in the liquor application, even though the total flow would be the same. For example, it is possible to find that the liquor has penetrated to the back of the fabric substrate at a 15% wet pickup level through one applicator, while there will not be any evidence of liquor on the back of the fabric substrate if the same total wet pickup of 15% is applied in fractionated succession through five applicators. When the fabric exits the chamber 68 the reduced, leuco-state dye is almost instantly oxidized as it is exposed to ambient air.

An interesting advantage of the present invention is that when the foam collapses, the nitrogen used to create the foam is released into the environment within the chamber 68, thereby enhancing the nitrogen content in the chamber 68 in replenishing any nitrogen that has escaped from the chamber. This reduces the amount of nitrogen that must be supplied to the chamber 68.

The number of applicators used in an apparatus according to the present invention may be varied from one to as many as six or more, depending on the application flexibility desired. Further, the application of the liquor can be done at ambient temperature, but, if desired, elevated temperatures could be utilized to provide some advantage on certain fabrics and procedures.

While the drawings illustrate and the detailed description describes an apparatus having four applicators, it should be understood that the apparatus can be operated with all or less than all applicators, including with only one applicator, actively applying foamed dye, and that the invention may be practiced with apparatus made with only one applicator therein or any desired number of applicators, all of which may be active or some of which may be inactive.

The pressure of nitrogen within the chamber 68 need be only slightly more than atmospheric pressure. It needs to be sufficiently higher than atmospheric pressure to prevent ambient oxygen-containing atmosphere from entering the chamber 68 and causing oxidation of the applied dye.

Figure 9:
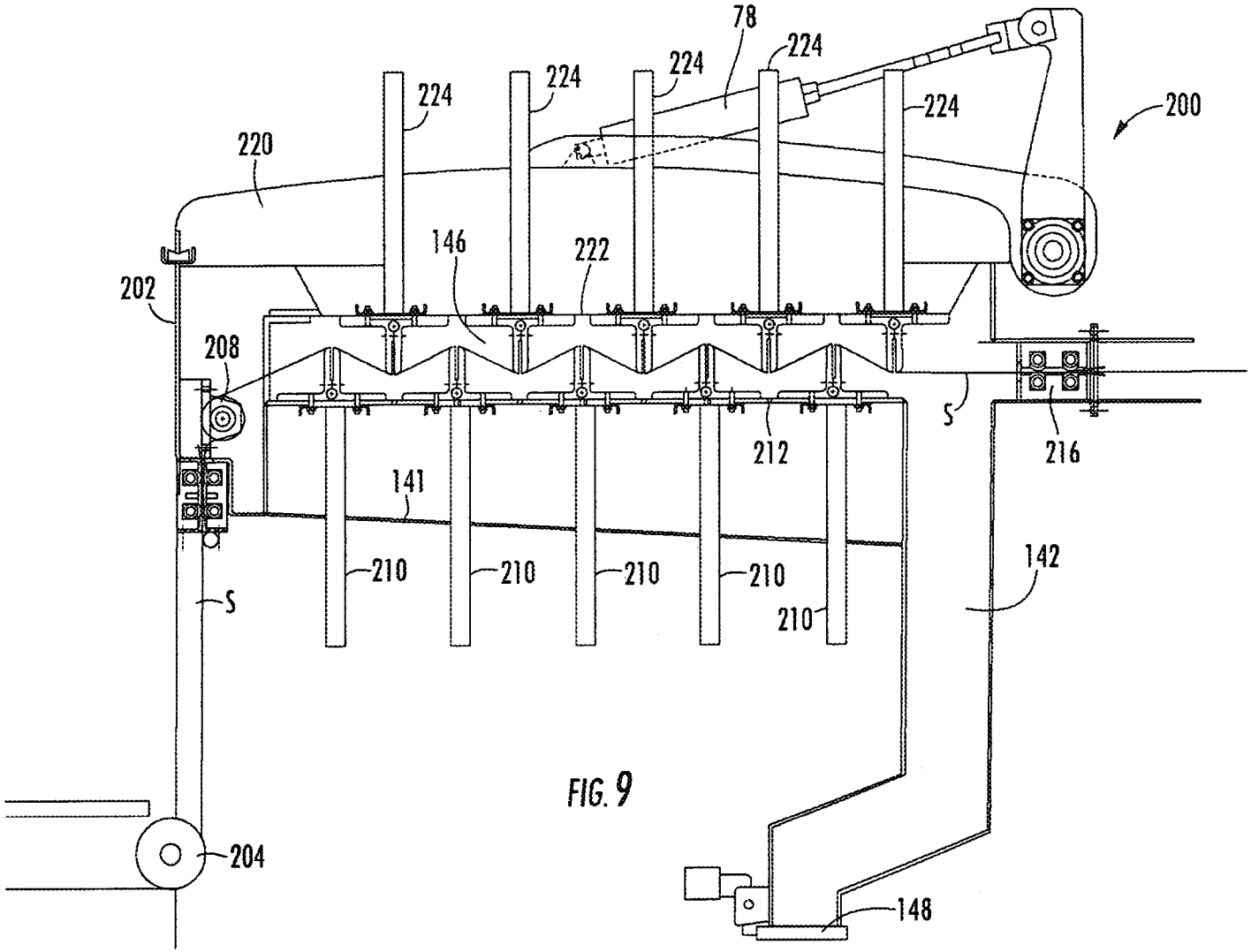
FIG. 9 is a view similar to FIG. 6 showing the apparatus modified to have a plurality of holddown elements in the form of inverted applicators.

Instead of using idler rollers as the holddown elements, inverted applicators can be used, as illustrated in FIG. 9. In this illustration, the apparatus 200 is similar to that of FIGS. 6 and 8 in that it includes a housing 202, a first guide roll 204 an entry seal 206, an entrance guide roll 208, a plurality of upwardly facing applicators 210 mounted on a platform 212, followed by an exit seal 216.

The apparatus 200 has an openable cover 220 similar to the cover of FIGS. 6 and 8. However, it does not include a separate frame. Rather, the cover 220 has an interior downwardly offset platform 222 on which are mounted holddown elements in the same locations and for the same purposes as the idler roller holddown elements of FIGS. 6 and 8. In this variation the holddown elements are inverted applicators 224 identical to, but inverted, in comparison with, the lower applicators 210. These inverted applicators 224 serve the same holddown purpose as the rollers of FIGS. 6 and 8 and additionally serve to apply foamed dye to the top surface of the substrate S as the top surface of the substrate passes under the applicator faces 226 of the inverted applicators 224.

With these inverted applicator holddown elements, the same or different dyes can be applied to the upper surface than the under surface of the substrate and various different dyes can be applied through each applicator, including leuco-type dyes and standard dyes, with the apparatus 200 operating either with a sealed inert atmosphere or unsealed ambient atmospheric air contained in the apparatus 200.

Another form of the preferred embodiment of the present invention is illustrated in FIGS. 10-18. It comprises a dyeing apparatus 300 similar to the apparatus 10 and 200 of the previously described forms, and capable of being incorporated in an overall dyeing range similar to the dyeing range 12 of the previously described embodiment. With reference to the range as illustrated in FIG. 2, the apparatus 300 of the embodiment of FIGS. 10-18 would use a similar inert gas source, foam generator and dye supply tank when the apparatus 300 is being used with an inert atmosphere in the manner of the apparatus 10 and 200 described above. The apparatus 300 of this form of the present embodiment may also be used with ambient air, in which case the source of inert gas would not be included and only the foam generator and source of dye would be used, with the source of dye and foam generator not requiring an inert condition.

The apparatus 300 includes a housing 302 supported on legs 304 and having end walls 306, side walls 308, a bottom wall 310 and a cover 312. These walls 306, 308, 310 and the cover 312 form an interior chamber 314. To use the apparatus 300 for dyeing with leuco-state dye, as in the previously described embodiment, the chamber 314 can be air tight with the cover 312 sealed on top of the walls in the same manner as the sealing of the cover 74 of the previously described embodiment.

A traveling textile fabric substrate S is fed to the chamber 314 by an entry roller assembly 316 having three rollers, two of which 318 are vertically spaced, and a third roller 320 is offset therebetween. The rollers are driven by a motor 322, (illustrated in FIG. 12). After passing through the entry roller assembly 316, the substrate S travels around a tension detection roller 324 that is mounted on a load cell 326, from which the substrate S travels into the chamber 314 through an entry end seal 328. The substrate exits the chamber 314 at the other end thereof through an exit end seal 330, which is identical to the entry end seal 328, and through an exit roller assembly 332 having an arrangement of two spaced rollers 334 and an offset roller 336 similar to the rollers 318 and 320 of the entry roller assembly 316. A motor similar to and synchronized with the entry roller assembly drive motor 322 drives the rollers 334 and 336.

Figure 13:
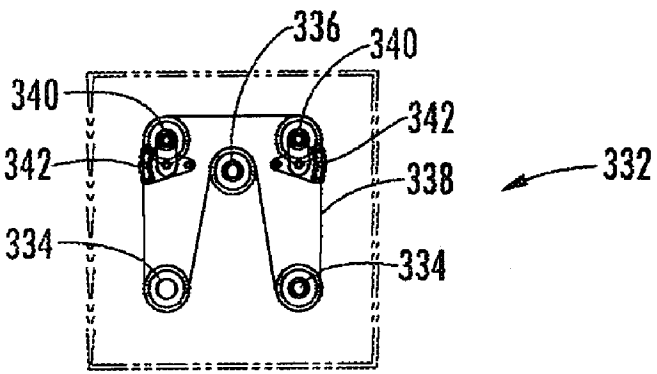
FIG. 13 is a side elevation of the exit roller assembly of FIG. 10.

FIG. 13 illustrates the exit roller assembly 332. As seen in FIG. 13, a drive belt 338 passes around the offset roller 336 and spaced rollers 334 and two guide pulleys 340. Belt tensioning elements 342 are adjustably mounted in contact with the drive belt 338 to maintain the belt in driving tension.

Mounted in the housing 312 and extending into the chamber 314 are five foam applicators 344. These foam applicators 344 extend across the apparatus and are spaced from each other and extend parallel with each other for sequential travel of the substrate S over the applicators.

Figure 14:
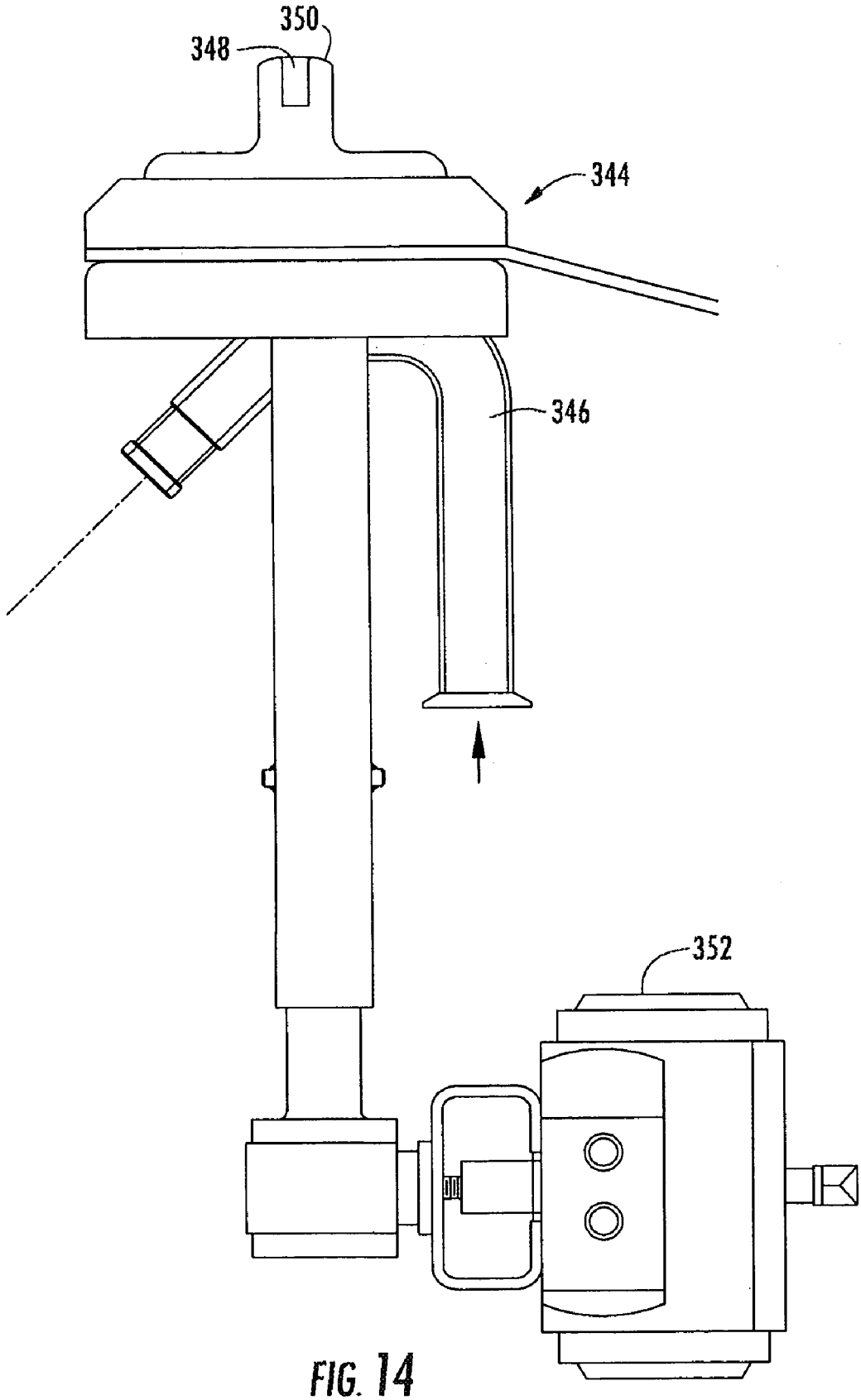
FIG. 14 is an enlarged view of one of the applicators of the apparatus of FIG. 10.

The applicators 344 are similar to the applicators 96-104 illustrated above and described in relation to the embodiment of FIGS. 1-8 and 210 of FIG. 9 and as disclosed in U.S. Pat. No. 4,655,056 issued Apr. 7, 1987 to Dieter F. Zeiffer. As seen in the enlargement of FIG. 14, each applicator 344 has an L-shaped conduit 346 through which foamed dye is supplied from a foam supply. The L-shaped conduit 346 opens into the top of the parabolic applicator 344 and is displaced therein to the slot 348 of the applicator face 350 over which the substrate travels and receives foam from the applicator. The applicator face 350 is rounded convexly to allow the substrate S to cover the slot 348 without appreciable leakage of foam therefrom.

At the bottom of the parabolic applicators 344 a pneumatically operable ball valve 352 is operated to allow draining of the applicators at the end of an application or to otherwise purge or empty the applicators into a drain manifold 354.

The substrate is held down against the applicator faces 350 to assure proper application of foam to the surface of the substrate without significant leakage. This is accomplished by four holddown rollers 356, each intermediate two applicators 344, and a first holddown roller 358 in advance of the first of the applicators and a last holddown roller 360 following the last applicator. Each of the intermediate, first and last holddown rollers 356, 358 and 360 extend downwardly below the level of the applicator faces 350 so as to cause the engaged substrate S to travel upwardly to and downwardly from the applicator faces 350. The first holddown roller engages 358 the substrate at the level at which it enters through the entry end seal 388, and the last holddown roller 360 positions the substrate to travel therefrom at the level of the exit end seal 330.

To avoid the complication of a drive mechanism and the necessity of a seal for an exterior drive or power source, particularly when the interior chamber 314 is to be sealed from ambient air, the holddown rollers 356, 358 and 360 are idler rollers, but, not being driven, they cannot drive the substrate S at a uniform tension. For this reason all of the holddown rollers 356, 358 and 360 are attached to the underside of the cover 312 with spacer blocks 362 that determine the downward extent of each of the holddown rollers, and the number of spacer blocks 362 mounted with the intermediate holddown rollers 356 decreases with successive rollers in the downstream direction of travel of the substrate S, thereby decreasing the depth of the successive holddown rollers, resulting in a decrease in the angle of inclination of the substrate as it progresses over successive applicator faces, thereby reducing the amount of friction being developed that causes increased tension. Uniform tension is advantageous as it results in the amount of foam applied at each applicator being as close as possible to a uniform amount. Variations in tension in the substrate will result in variations in the amount of foam applied to the surface of the substrate by the applicators. The amount of tension in the substrate is controlled by the relative drive speeds of the rollers of the entry roller assembly 316 and rollers of the exit roller assembly 332, and by the decreasing number of spacer blocks 362 in the sequence of holddown rollers. In this regard, it is desirable that the increase in tension in the substrate as it travels through the apparatus be limited to approximately the range of 1 to 2½ times the tension in the substrate entering the apparatus. The spacer blocks 362 may be of any size and number that provides optimum results. For example, spacer blocks 362 of ⅛, 3/16 or ¼ of an inch thickness decreasing in number from about 6 to about 3 may be used to provide satisfactory results depending on the circumstances.

It is desirable that the spacing between applicators 344 be sufficient to permit at least partial collapse of the foam between applicators so that the dye will effectively be absorbed in the surface fibers of the fabric substrate before foam is applied by the next applicator. This, in combination with the decreasing depth of the intermediate holddown rollers 356 results in relatively uniform application of foam from each applicator without significant moisture being absorbed into the fabric. With the apparatus of the present invention, the quantity of dye foam that is normally applied when using one applicator can now be divided and applied in a fraction at each applicator. For example, in the apparatus as illustrated, the foamed dye is applied one-fifth through each applicator, with each application being applied only to the surface of the substrate rather than the foamed dye penetrating significantly into the fabric when all of the foamed dye is applied at one applicator. In a typical operation, the moisture pick up with the apparatus of the present invention may be 15% of the weight of the fabric in comparison with 90% to 100% moisture pick up in a conventional dyeing operation. As a result, time consuming drying can be significantly reduced or eliminated and waste water can be minimized.

To limit the discharge of foam to the width of the substrate S, side seals 364 and 366 are provided similar to the side seals 60 of the embodiment of FIGS. 3 and 4. The edge of the traveling substrate can be sensed by sensing forks, such as described in the preceding embodiment, which sensing forks are identified by the numeral 56 in FIG. 3, or electronic sensors of various sorts may be used.

When the apparatus 300 is used to apply leuco-state dye, requiring an inert atmosphere, the bottom wall 310 is located close to the upper extent of the applicators 344 to minimize the volume of the chamber 314 and thereby minimize the amount of inert gas needed to be maintained in the chamber. Also, when using a leuco-state dye, the space between the entry end seal 328 and the first applicator 344 is significant as it allows the dissipation of at least some of the oxygen that may be entrapped in the entering substrate. Similarly, the space between the last applicator and the exit end seal 330 is significant as it allows at least partial collapse of the foam with the dye fastening to the substrate before being exposed to the atmosphere.

Figure 10:
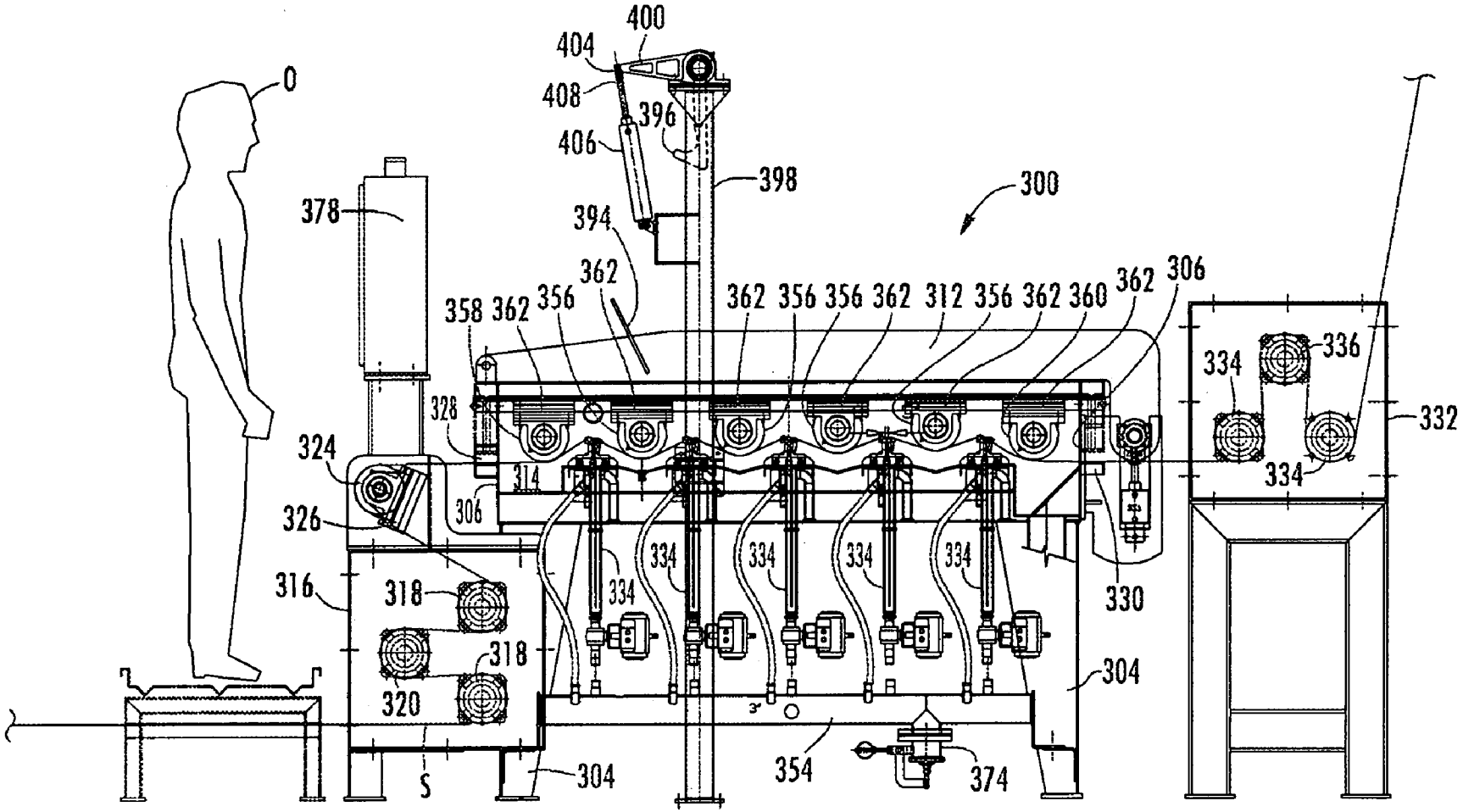
FIG. 10 is a side elevation of the apparatus of another form of the preferred embodiment of the dyeing apparatus of the present invention with the side panel removed.
Figure 11:
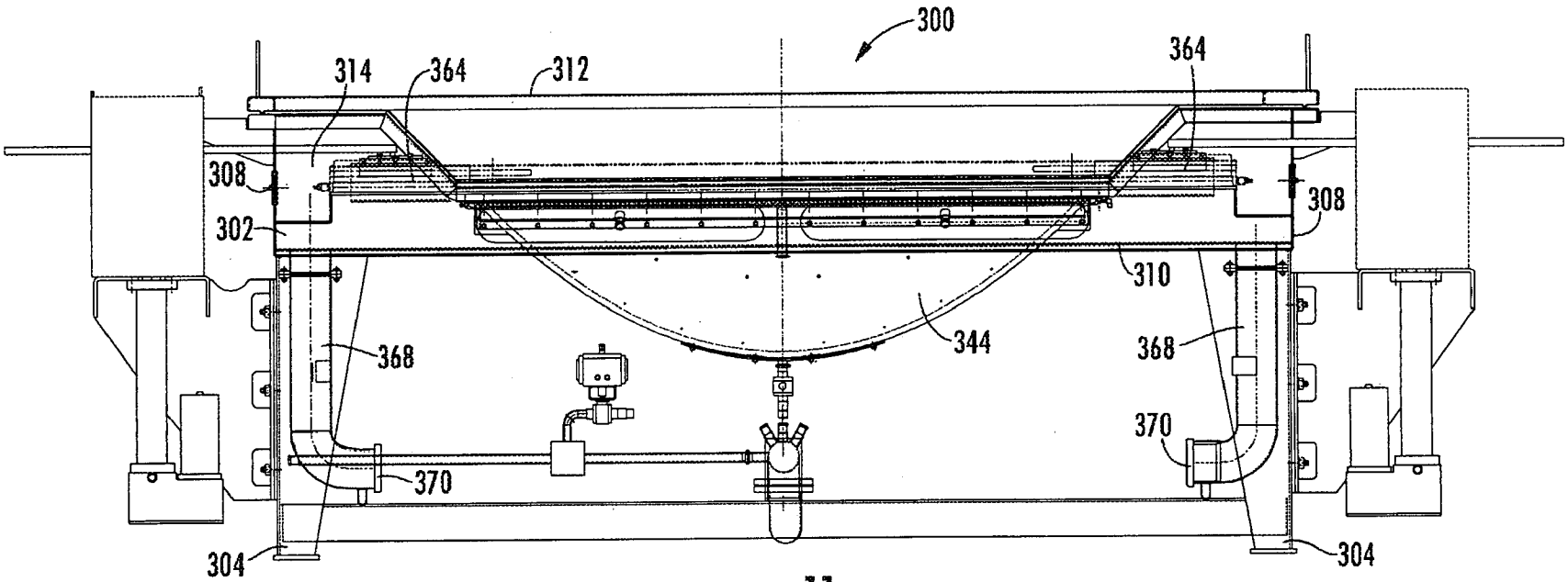
FIG. 11 is an end elevation of the apparatus of FIG. 10.
Figure 12:
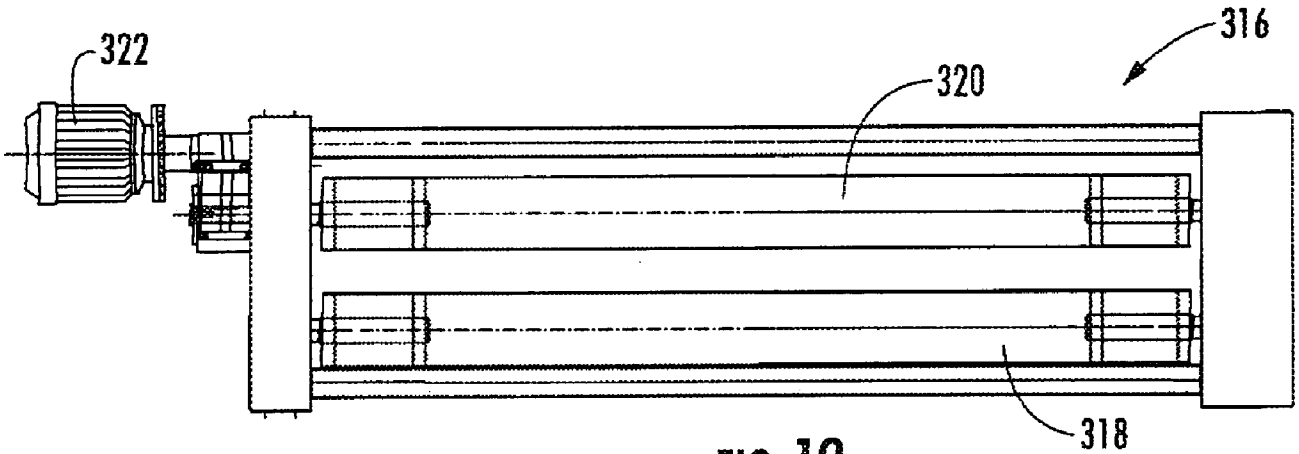
FIG. 12 is a side elevation of the entry roller assembly of the apparatus of FIG. 10.

As seen in FIG. 11, any unapplied foam that accumulates as liquid in the chamber 314 drains through side conduits 368 to flaps 370 that are openable manually or automatically as desired. Similarly, a drain valve 374 on the drain manifold 354 (FIG. 10) is operable to discharge accumulated liquid from the drain manifold 354.

Monitoring and control of the operation of the apparatus 300 is conducted by an Operator O using the control panel 378 mounted at the entry side of the apparatus 300.

The embodiment of the apparatus 300 in FIGS. 10-18 can be used either to apply leuco-state dyes or non-leuco-state dyes to substantially equal advantage. When utilizing the apparatus 300 to dye non-leuco-state dye, it is not necessary that a chamber be formed or that end seals be provided air tight or that the cover be sealed in place. Rather, ambient air is present before and after the lid is closed and can enter through unsealed openings, including the opening resulting from disconnection from the inert gas supply. Also, air is released from the foam as it collapses.

Figure 16:
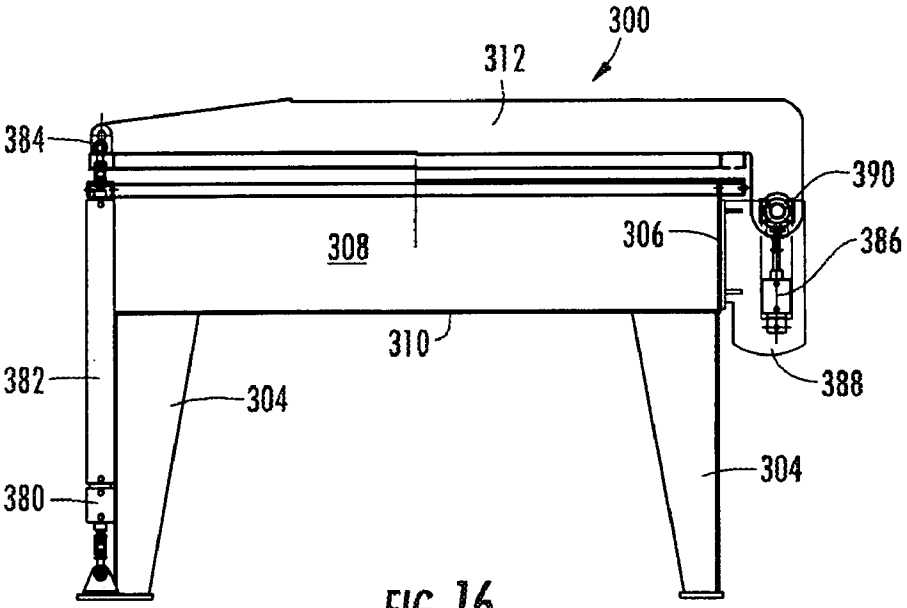
FIGS. 15, 16 and 17 illustrate the manipulation of the cover of the apparatus of FIG. 10 from a closed position (FIG. 15) to an initial vertically raised position (FIG. 16) to a pivoted open position (FIG. 17)
Figure 15:
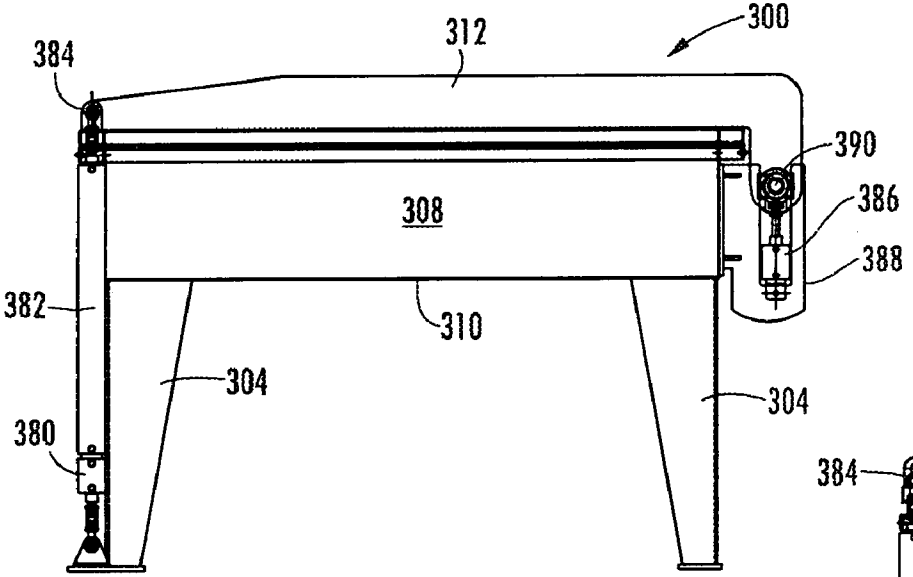
Figure 18:
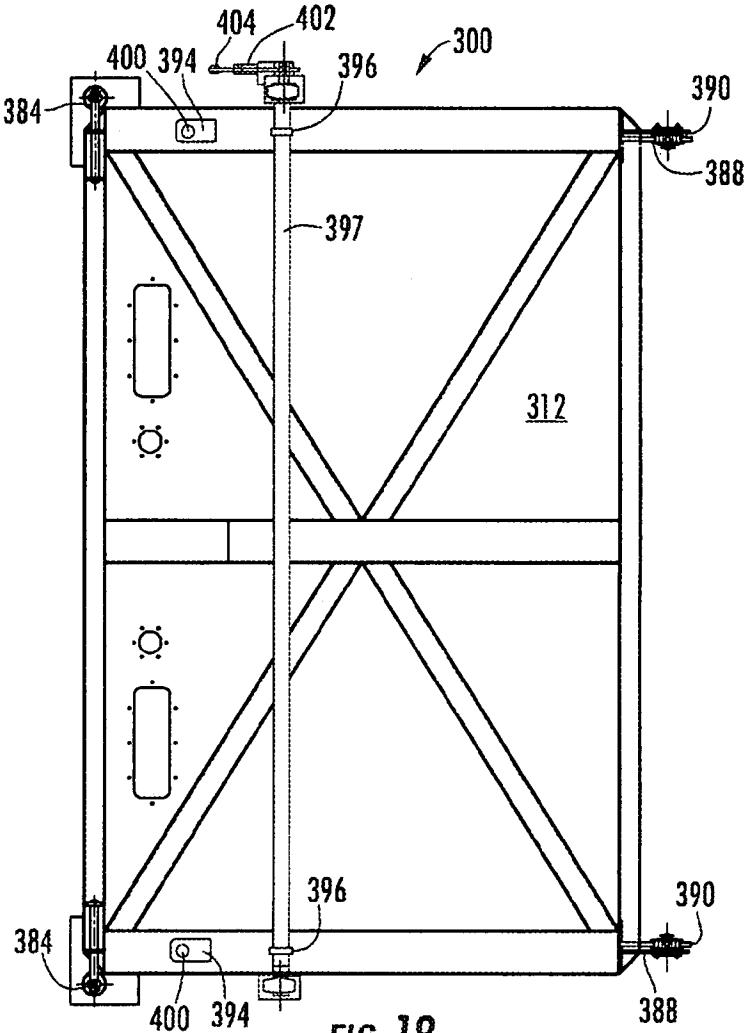
FIG. 18 is a plan view of the cover of the apparatus of FIG. 10.
Figure 17:
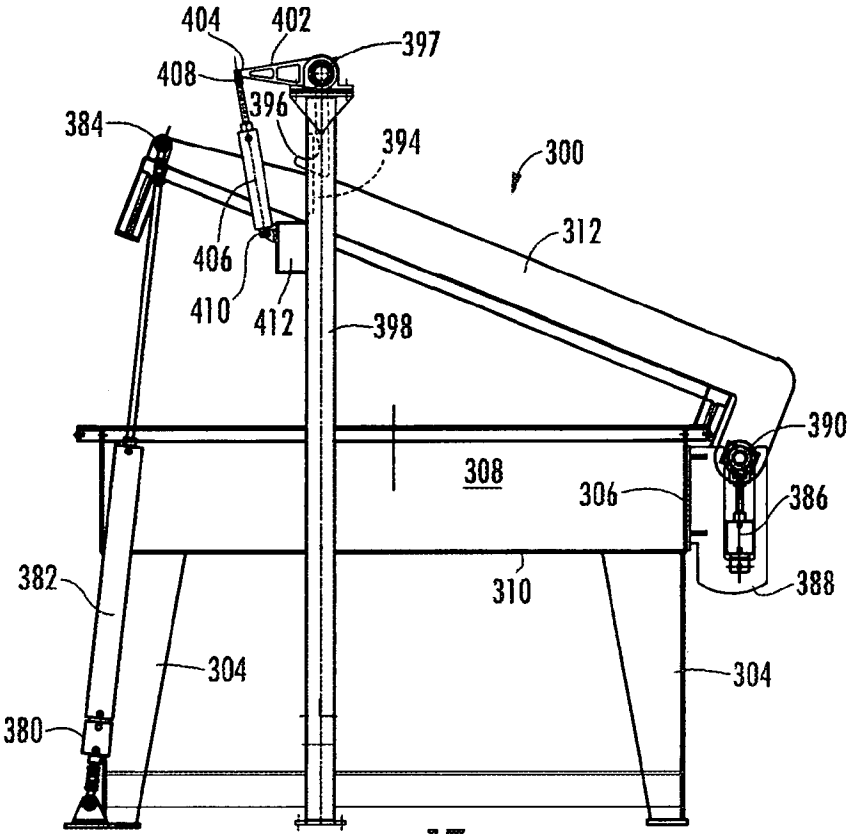

FIGS. 15, 16 and 17 illustrate the sequence of operation in opening the cover 312. FIG. 15 shows the cover closed during operation of the apparatus. The first step in opening is to raise the cover 312 vertically. This is accomplished by extension of short front piston-cylinder mechanisms 380 at the bottom of the front legs 304 of the apparatus 300. These short piston-cylinder mechanisms 380 are attached to the lower ends of long front piston-cylinder mechanisms 382. The upper ends 384 of the front piston-cylinder mechanisms 382 are attached to the front corners of the cover 312, which is raised by the extension of the short front piston-cylinder mechanisms 380 and simultaneously by extensions of short rear piston-cylinder mechanisms 386 mounted on rear corner extensions 388 of the housing 302. The upper ends of the rear piston-cylinder mechanisms 386 are attached to corner pivots 390 of the cover 312 with the extension of the rear piston-cylinder mechanisms 386 raising the rear of the cover 312 to the same height as the front of the cover is raised by the front piston-cylinder mechanisms 380. This initial vertical raising of the cover 312 is particularly desirable when the cover 312 is sealed during operation.

Subsequent to the initial vertical raising of the cover 312, the front piston-cylinder mechanisms 382 are extended fully to raise the front of the cover 312, during which the cover pivots about the rear pivots 390 to swing the cover 312 open to a position as shown in FIG. 17. As the cover 312 approaches the upper extent of its pivoting, latch plates 394 secured at an inclination at the sides of the top of the cover 312 engage latches 396 pivotally mounted on a reciprocal cross rod 397 mounted on and extending between upstanding posts 398 until the latch plates 394 displace the latches 396 sufficiently for the latches 396 to engage in openings 400 in the latch plates 394, thus holding the cover 312 in the open position illustrated in FIG. 17. An arm 402 fixed to and extending from one end of the rod 397 has an outer end 404 attached to a spring mechanism 406 having an end 408 fixed to the reciprocal cross rod 397 and its other end 410 attached to a bracket 412 on the post 398. The spring mechanism 406 normally urges the cross rod 397 to position the latches 396 into downwardly extending positions, as shown in FIG. 10. The latches 396 and latch plates 394 connection is disengaged either manually or mechanically when it is desirable to pivot the cover 312 downwardly to its closed position.

The spacer blocks 362 described in relation to the form of the present invention illustrated and described with relation to FIGS. 10-18 can also be used with the forms of FIGS. 1-8 and FIG. 9 for the same purpose and to obtain the same advantages. Further, all of the forms of the present invention described herein may be used with leuco-type dyes and also with other dye systems that are not leuco systems, such as sulfur dyes, vat dyes, conventional aqueous textile dyes and any other dye that is capable of application in a foam form, and heating systems can be included for best results with a particular dye selected. Also, the textile fabric substrate may be woven material, knit material or non-woven material of cellulosic, non-cellulosic or blends thereof. Furthermore, the applicators in any of the forms of the present invention can be each supplied individually or in combinations by dedicated individual foam generators to simultaneously supply different dyes and chemicals to the substrate and applying the material in layers.

The apparatus of the present invention is particular applicable to dyeing substrate in fabric form, including heavy denim fabric for manufacturing jeans, which can be dyed in any variegated pattern for fashion effects, which is not done with conventional dyeing where yarn, not fabric, is dyed, although light-weight fabrics, not heavy jean fabrics are sometimes dyed in conventional machines.

In view of the aforesaid written description of the present invention, it will be readily understood by those skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative of examples of the present invention and is made merely for purposes of providing a full and enabling disclosure of the invention. The foregoing disclosure is not intended nor is it to be construed to limit the present invention or otherwise exclude any other embodiment, adaptations, variations, modifications and equivalent arrangements, the present invention being limited only by the claims appended hereto and the equivalents thereof.

What is claimed is:

1. An apparatus for dyeing a traveling textile fabric substrate, comprising:

a housing having an interior chamber through which said substrate travels from an entrance through which said substrate enters said chamber to an exit through which said substrate exits said chamber;

an entry roller assembly for feeding said traveling substrate to said entrance;

an exit roller assembly for drawing said traveling substrate from said chamber;

a plurality of spaced foam applicators in said chamber having applicator faces extending transversely of the traveling substrate for applying dye in foam form onto the surface of the substrate in increments, said applicators being spaced apart to permit at least partial collapse of foam between applicators;

a plurality of laterally extending holddown elements members in said chamber extending transversely of the traveling substrate between said applicators and extending below the level of said applicator faces to guide said substrate and hold said substrate down against said applicator faces;

said holddown members gradually decreasing in depth between applicators in the downstream direction of travel of the substrate to reduce the angle of inclination of the substrate as it travels over successive applicator faces to minimize the increase in tension of the substrate as it travels across successive applicator faces through the apparatus.

2. An apparatus for dyeing a traveling textile fabric substrate according to claim 1 and characterized further in that said holddown members are mounted to said housing with spacer blocks therebetween, the number of spacer blocks per holddown member between said applicators diminishing in the direction of travel of said substrate.

3. An apparatus for dyeing a traveling textile fabric substrate, comprising:

a housing having an interior chamber through which said substrate travels from an entrance through which said substrate enters said chamber to an exit through which said substrate exits said chamber;

an entry roller assembly for feeding said traveling substrate to said entrance;

an exit roller assembly for drawing said traveling substrate from said chamber;

a plurality of spaced foam applicators in said chamber having applicator faces extending transversely of the traveling substrate for applying dye in foam form onto the surface of the substrate in increments, said applicators being spaced apart to permit at least partial collapse of foam between applicators;

a plurality of laterally extending holddown elements members in said chamber extending transversely of the traveling substrate between said applicators and extending below the level of said applicator faces to guide said substrate and hold said substrate down against said applicator faces;

said housing includes an openable cover and said holddown members are mounted on said cover.

4. An apparatus for dyeing a traveling textile fabric substrate, comprising:

a housing having an interior chamber through which said substrate travels from an entrance through which said substrate enters said chamber to an exit through which said substrate exits said chamber;

an entry roller assembly for feeding said traveling substrate to said entrance;

an exit roller assembly for drawing said traveling substrate from said chamber;

a plurality of spaced foam applicators in said chamber having applicator faces extending transversely of the traveling substrate for applying dye in foam form onto the surface of the substrate in increments, said applicators being spaced apart to permit at least partial collapse of foam between applicators;

a plurality of laterally extending holddown elements members in said chamber extending transversely of the traveling substrate between said applicators and extending below the level of said applicator faces to guide said substrate and hold said substrate down against said applicator faces;

said interior chamber being substantially air tight with entry and exit air seals, said chamber being capable of containing an inert gas for effective application of a leuco state foamed dye onto a textile fabric substrate without significant oxidation of the dye until exiting the apparatus; and said housing includes an openable cover and said holddown rollers are mounted on said cover.

* * * * *

UNITED STATES PATENT AND TRADEMARK OFFICE

CERTIFICATE OF CORRECTION

PATENT NO. : 7,913,524 B2
APPLICATION NO. : 12/012077
DATED : March 29, 2011
INVENTOR(S) : Christoph Walter Aurich, Dieter Friedrich Zeiffer and Hermann A. Neupert It is certified that error appears in the above-identified patent and that said Letters Patent is hereby corrected as shown below:

Amend Claim 1, column 13, line 61, delete “members”
column 13, line 66, delete “members” and insert -- elements --
Amend Claim 2, column 14, line 8, delete “members” and insert -- elements --
column 14, line 10, delete “member” and insert -- element --
Amend Claim 3, column 14, line 29, delete “members”
column 14, line 34, delete “members” and insert -- elements --
Amend Claim 4, column 14, lines 50 and 51, delete “members”
column 14, line 63, delete “rollers” and insert -- elements --

Signed and Sealed this
Twenty-third Day of August, 2011

David J. Kappos

David J. Kappos
*Director of the United States Patent and Trademark Office*